US011077658B2

(12) United States Patent
Ishiwata et al.

(10) Patent No.: US 11,077,658 B2
(45) Date of Patent: Aug. 3, 2021

(54) LIQUID EJECTION HEAD AND METHOD OF MANUFACTURING THE SAME

(71) Applicant: CANON KABUSHIKI KAISHA, Tokyo (JP)

(72) Inventors: Tomoki Ishiwata, Kawasaki (JP); Shuzo Iwanaga, Kawasaki (JP); Masaki Oikawa, Inagi (JP); Keiji Tomizawa, Yokohama (JP); Tomohiro Sato, Tokyo (JP); Akiko Hammura, Tokyo (JP); Chiaki Muraoka, Kawaguchi (JP); Shimpei Yoshikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/556,087

(22) Filed: Aug. 29, 2019

(65) Prior Publication Data

US 2020/0070513 A1 Mar. 5, 2020

(30) Foreign Application Priority Data

Sep. 5, 2018 (JP) ..... JP2018-165902

(51) Int. Cl.
*B41J 2/14* (2006.01)

(52) U.S. Cl.
CPC ..... *B41J 2/14072* (2013.01); *B41J 2/14024* (2013.01); *B41J 2202/11* (2013.01); *B41J 2202/19* (2013.01); *B41J 2202/22* (2013.01)

(58) Field of Classification Search
CPC ..... B41J 2/14072; B41J 2/14024; B41J 2202/11; B41J 2202/19; B41J 2202/22
See application file for complete search history.

(56) References Cited

U.S. PATENT DOCUMENTS 6,151,045 A * 11/2000 Beach ..... B41J 2/1433 347/45

FOREIGN PATENT DOCUMENTS

JP H08-048042 A 2/1996
JP 2016-43515 A 4/2016

* cited by examiner

*Primary Examiner* — Geoffrey S Mruk
(74) *Attorney, Agent, or Firm* — Canon U.S.A., Inc. IP Division

(57) ABSTRACT

A liquid injection head improving electric reliability includes: a substrate including: energy generating elements configured to apply energy for ejection to a liquid, and a substrate upper surface on which terminals respectively connected to electric wirings are provided, an ejection port forming member having: an ejection port forming surface in which the ejection ports for ejecting a liquid are formed, and a back surface on a side opposite to the ejection port forming surface, which is arranged so as to opposite to the substrate upper surface, and a sealant configured to cover connecting portions between the electric wirings and the terminals.

8 Claims, 9 Drawing Sheets

$$\frac{2}{3}\pi R\rho g > \frac{\sigma}{\pi R}$$

$$\frac{2}{3}\pi R\rho g > \frac{\sigma}{\pi R}$$

$$\frac{2}{3}\pi R\rho g < \frac{\sigma}{\pi R}$$

LIQUID EJECTION HEAD AND METHOD OF MANUFACTURING THE SAME

BACKGROUND OF THE INVENTION

Field of the Invention

The present disclosure relates to a liquid ejection head and a method of manufacturing the same.

Description of the Related Art

An element substrate for an ink jet recording head includes an electrode portion configured to supply a drive signal to an energy generating element configured to apply energy for ejection to an ink. When the ink adheres to the electrode portion, the electrode portion may wear. In order to prevent such inconvenience, the electrode portion is sealed to improve electric reliability.

In Japanese Patent Application Laid-Open No. H08-048042, there is described a technology of forming a cutout in part of an ejection port forming member having ejection ports formed therein. With the cutout, a shape of a sealant (adhesive) provided on the electrode portion is defined, thereby being capable of preventing entry of the sealant into the ejection ports.

In general, a surface of the ejection port forming member is water-repellent finished. The water-repellent finishing is performed to prevent the ink from adhering to an edge of each of the ejection ports so as to suppress adverse influence on printing due to unstable ejection, which may be caused by adhesion of the ink. Meanwhile, when the sealant is applied onto the water-repellent finished surface of the ejection port forming member, the sealant is liable to peel off due to low adhesion between the ejection port forming member and the sealant. When the sealant peels off, the ink ejected from the ejection ports may enter the electrode portion to thereby cause an electrical failure at the electrode portion. With a lifetime of a related-art ink jet recording head, sufficient reliability is obtained even in a structure described above. In order to prolong the lifetime of the ink jet recording head, however, a structure for improving electric reliability is expected.

With the technology described in Japanese Patent Application Laid-Open No. H08-048042, the cutout is formed in the surface of the ejection port forming member, and the sealant is provided so as to cover even the cutout. In the structure described above, a sealing region is defined to suppress the entry of the sealant into the ejection ports. However, even the water-repellent finished surface of the ejection port forming member is sealed. Thus, a region having low adhesion is sealed, and hence the adhesion is low. Thus, a structure for improving the adhesion is demanded so as to further prolong the lifetime of the ink jet recording head.

SUMMARY OF THE INVENTION

The present disclosure provides a liquid ejection head and a method of manufacturing the same to address the above-mentioned circumstances.

There is provided a liquid injection head including: a substrate including: energy generating elements configured to apply energy for ejection to a liquid, and a substrate upper surface on which terminals respectively connected to electric wirings are provided; an ejection port forming member having: an ejection port forming surface in which the ejection ports for ejecting a liquid are formed; and a back surface on a side opposite to the ejection port forming surface, which is arranged so as to opposite to the substrate upper surface; and a sealant configured to cover connecting portions between the electric wirings and the terminals, wherein at least an ejection port region of the ejection port forming surface, in which the ejection ports are formed, is formed as a high water-repellency region, wherein an end region of the ejection port forming surface, which is located between the ejection port region and the terminals when the substrate upper surface is viewed in plan view, is formed as a low water-repellency region having water repellency lower than water repellency of the high water-repellency region, and wherein at least part of the end region is covered with the sealant.

There is provided a method of manufacturing a liquid ejection head, the liquid ejection head including: a substrate including: energy generating elements configured to apply energy for ejection to a liquid; and a substrate upper surface on which terminals respectively connected to electric wirings are provided; an ejection port forming member having: an ejection port forming surface in which the ejection ports for ejecting a liquid are formed; and a back surface on a side opposite to the ejection port forming surface, which is arranged so as to opposite to the substrate upper surface; and a sealant configured to cover connecting portions between the electric wirings and the terminals, the method including: providing the ejection port forming member so as to be in contact with the substrate upper surface, forming at least an ejection port region of the ejection port forming surface, in which the ejection ports are formed, as a high water-repellency region and forming an end region of the ejection port forming surface, which is located between the ejection port region and the terminals when the substrate upper surface is viewed in plan view, as a low water-repellency region having lower repellency than repellency of the high water-repellency region; and covering at least part of the end region with the sealant.

Further features of the present disclosure will become apparent from the following description of exemplary embodiments with reference to the attached drawings.

DESCRIPTION OF THE EMBODIMENTS

First Embodiment (Description of Element Substrate of Liquid Ejection Head)

Figure 1:
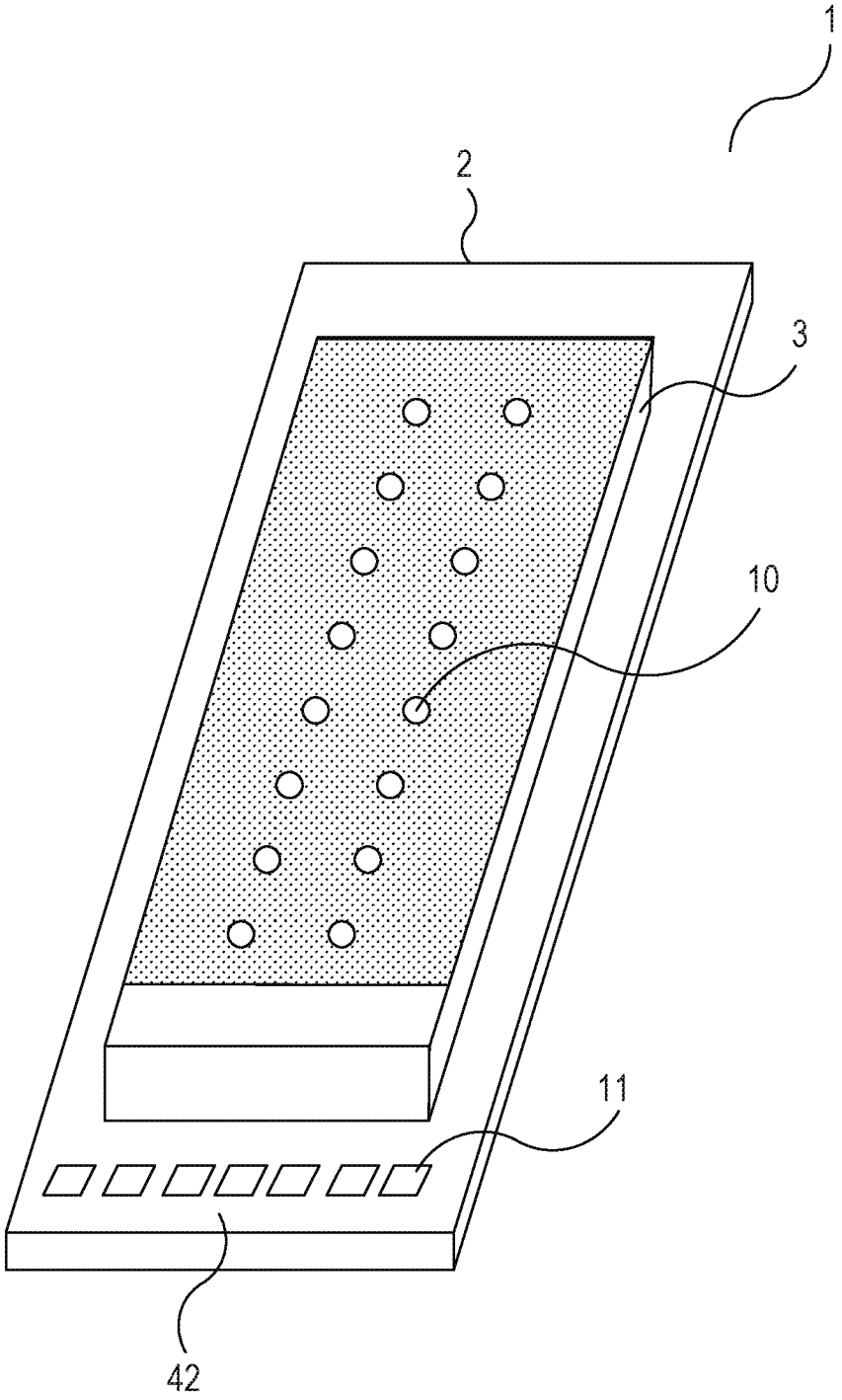
FIG. 1 is a perspective view for illustrating an element substrate in a liquid ejection head according to a first embodiment of the present disclosure.

FIG. 1 is a perspective view for illustrating an element substrate 1 in a liquid ejection head according to a first embodiment of the present disclosure. As illustrated in FIG. 1, the element substrate 1 includes an ejection port forming member 3 and a substrate 2. The substrate 2 includes an electric circuit. The ejection port forming member 3 has a plurality of ejection ports 10 configured to eject an ink therethrough. Ink droplets are ejected from the ejection ports 10 to form an image. The ejection port forming member 3 is made of a photosensitive resin. The substrate 2 includes energy generating elements (illustrated in FIG. 2A as an energy generating element 19) and terminals 11. The energy generating elements 19 are configured to apply energy for ejection to the ink. The terminals 11 correspond to electrode portions, each being configured to receive a control signal and a drive voltage for driving a corresponding one of the energy generating elements. The terminals 11 are formed in a terminal formation region 42. The element substrate 1 is connected to an external power supply through the terminals 11, and the energy generating elements are driven based on the control signals and the drive voltages, which are received from the outside.

Figure 2A:
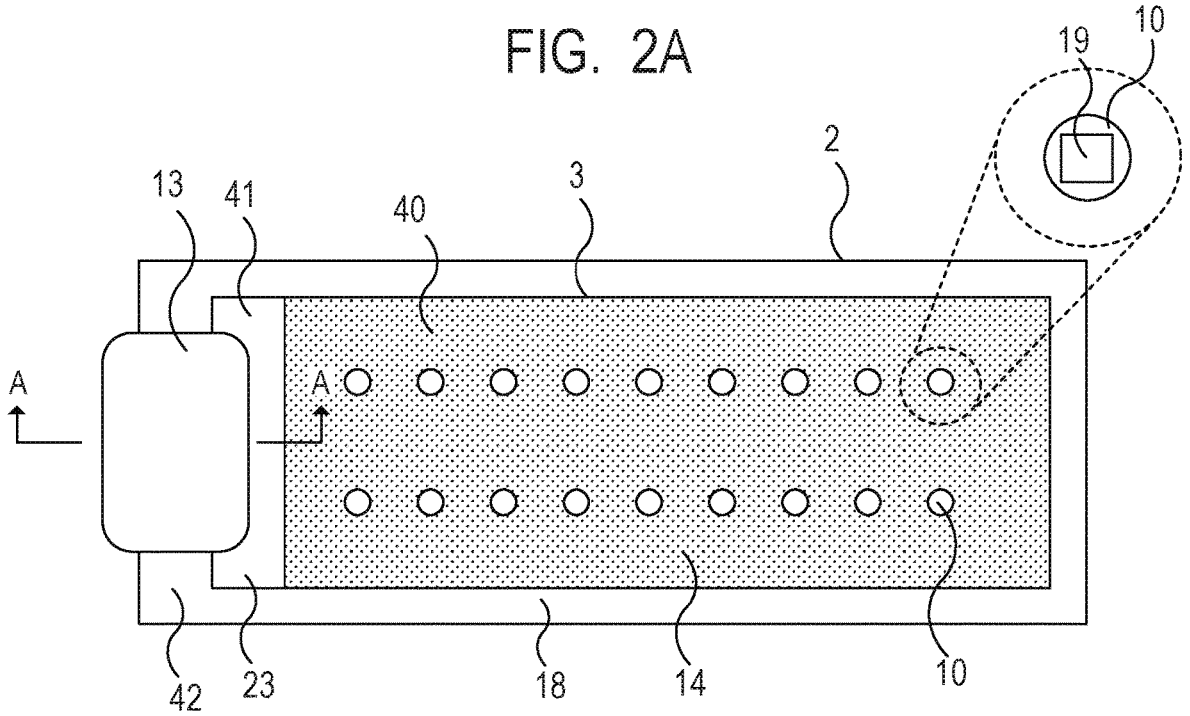
FIG. 2A is an example of a plan view of the element substrate illustrated in FIG. 1, and FIG. 2B and FIG. 2C are examples of a sectional view of part of the element substrate illustrated in FIG. 1, which is in the vicinity of terminals.
Figure 2B:
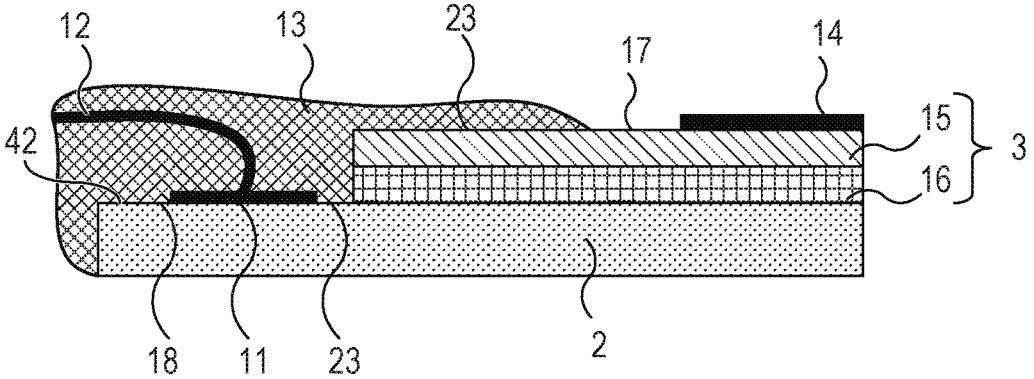
Figure 2C:
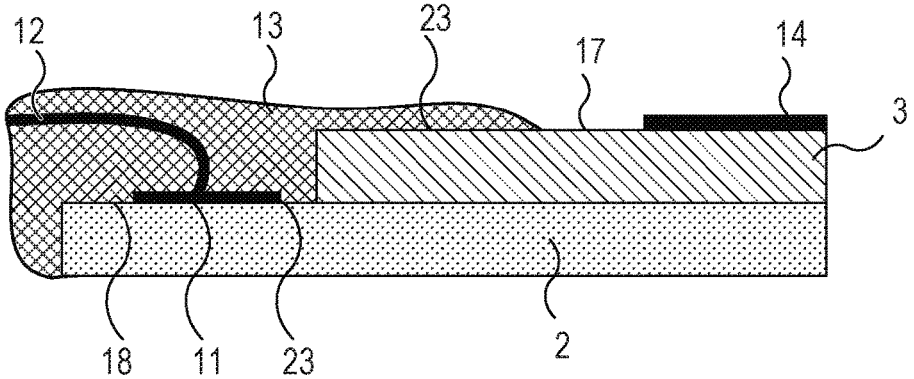

FIG. 2A is an example of a plan view of the element substrate 1 illustrated in FIG. 1. FIG. 2B and FIG. 2C are examples of a sectional view of part of the element substrate 1 illustrated in FIG. 1, which is in the vicinity of the terminals 11, and are taken along the line A-A of FIG. 2A. As illustrated in FIG. 1 and FIG. 2B, the ejection port forming member 3 includes a top plate 15 and a flow passage member 16. The top plate 15 has the ejection ports 10 formed therethrough. The flow passage member 16 is configured to communicate with the ejection ports 10 and form an ink supply flow passage. A surface of the ejection port forming member 3, in which the ejection ports 10 are formed, is an ejection port forming surface 17. The substrate 2 and the ejection port forming member 3 are joined to each other so that a surface of the ejection port forming member 3, which is on the side opposite to the ejection port forming surface 17, is opposite to a substrate upper surface 18 on which the terminals 11 are provided. As illustrated in FIG. 2C, the top plate 15 and the flow passage member 16 may be integrally formed of the same member. As illustrated in FIG. 2A, the energy generating elements 19 are provided at positions opposed to the ejection ports 10 that are in communication with a pressure chamber (not shown). As illustrated in FIG. 1 and FIG. 2A, a high water-repellency region 14, which has been water-repellent finished, is formed around the ejection ports 10 on the ejection port forming surface 17 of the ejection port forming member 3. More specifically, on an ejection port region 40 of the ejection port forming surface 17 of the top plate 15 in which the ejection ports 10 are formed therethrough, the high water-repellency region 14, which is the water-repellent finished region, is formed. With the high water-repellency region 14, occurrence of a printing failure due to ink accumulation on a surface around each of the ejection ports 10 is suppressed. A low water-repellency region 23, which has not been water-repellent finished, is formed adjacent to the high water-repellency region 14 formed on the ejection port forming surface 17 of the top plate 15. The substrate upper surface 18 of the substrate 2, which is oriented in the same direction as the ejection port forming surface 17, is part of the low water-repellency region 23. When the substrate upper surface 18 is viewed in plan view, an end region 41 located between the ejection port region 40 of the ejection port forming surface 17 and the terminals 11 is included in the low water-repellency region 23. The high water-repellency region 14 and the low water-repellency region 23 are not necessarily distinguished from each other based on whether the region is water-repellent finished or not. In this specification, a region having a relatively large angle (hereinafter referred to "contact angle") formed between a tangent of the liquid droplet at a contact portion of the ink droplet dropped onto, for example, the ejection port forming surface 17 with the ejection port forming surface 17 and the ejection port forming surface 17 is defined as the high water-repellency region 14. Meanwhile, a region having a relatively small contact angle is defined as the low water-repellency region 23.

As illustrated in FIG. 2A to FIG. 2C, a sealant 13 is applied onto part of the substrate 2 and part of the ejection port forming member 3. The sealant 13 covers part of the end region 41 and the terminal formation region 42 of the substrate upper surface 18 of the substrate 2, on which the terminals 11 are formed. The terminal formation region 42 of the substrate upper surface 18 is part of the low water-repellency region 23. The sealant 13 covers at least part of the end region 41 of the ejection port forming surface 17. As a result, sealability of the sealant 13 to the top plate 15 can be improved. The terminals 11 are respectively connected to electric wirings 12 each configured to propagate a signal to a corresponding one of the energy generating elements configured to apply the energy for ejection to the ink. The terminals 11 and at least connecting portions of the electric wirings 12 to the terminals 11 are also covered with the sealant 13. Through the sealing of the terminals 11 and the part of each of the electric wirings 12 with the sealant 13, occurrence of short-circuiting between the terminals 11 and the electric wirings 12 due to the ink is suppressed. As a result, improvement of the sealability and improvement of electric reliability can be achieved. As described above, the high water-repellency region 14 is formed at least around the ejection ports 10 so as to reduce occurrence of the printing failure due to the ink accumulation on the ejection port forming surface 17. The low water-repellency region 23 is formed between the ejection ports 10 and the terminals 11 and to cover connecting portions between the terminals 11 and the electric wirings 12 so as to prevent flow of the ink to the terminals 11 and improve the sealability of the sealant 13.

(Description of Manufacturing Method for Carrying Out First Embodiment)

Now, a method of manufacturing the element substrate 1 illustrated in FIG. 1 is described. FIG. 3A to FIG. 3H are views for illustrating an example of the method of manufacturing the element substrate 1 illustrated in FIG. 1.

Figure 3A:
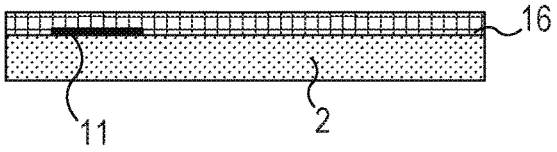
FIG. 3A, FIG. 3B, FIG. 3C, FIG. 3D, FIG. 3E, FIG. 3F, FIG. 3G and FIG. 3H are views for illustrating an example of a method of manufacturing the element substrate illustrated in FIG. 1.
Figure 3B:
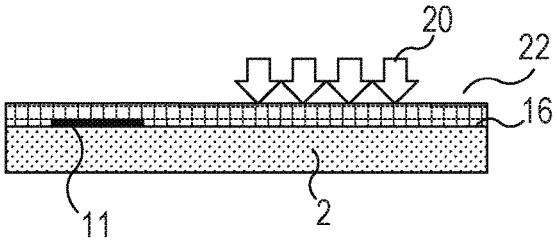

First, as illustrated in FIG. 3A, a photosensitive resin is formed by, for example, spin coating or lamination of a dry film so as to form the flow passage member 16 on an upper surface of the substrate 2 including the terminals 11. Subsequently, as illustrated in FIG. 3B, the photosensitive resin is exposed to light, for example, ultraviolet light 20. It is preferred that the photosensitive resin be a negative type photosensitive resin. The photosensitive resin is covered with an exposure mask 22 and is exposed to light so that a shape of the ink supply flow passage for supplying the ink to the ejection ports 10 is patterned on the photosensitive resin.

Figure 3C:
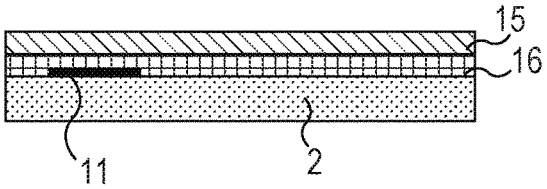
Figure 3D:
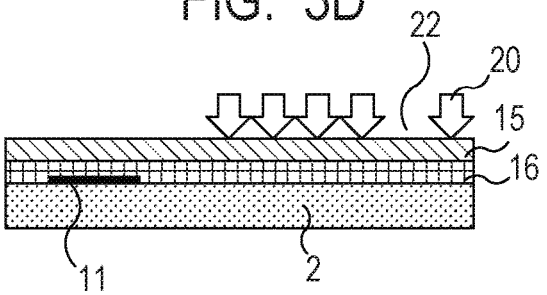

Subsequently, as illustrated in FIG. 3C and FIG. 3D, as in the step of forming the photosensitive resin and the step of light exposure described above with reference to FIG. 3A and FIG. 3B, the photosensitive resin is applied so as to form the top plate 15, and is exposed to light, for example, the ultraviolet light 20. As in the case of the flow passage member 16, it is preferred that a negative type photosensitive resin be used for the top plate 15. The photosensitive resin is covered with an exposure mask 22 having an exposure pattern for shapes and an arrangement pattern of the ejection ports 10, and is exposed to light.

Figure 3E:
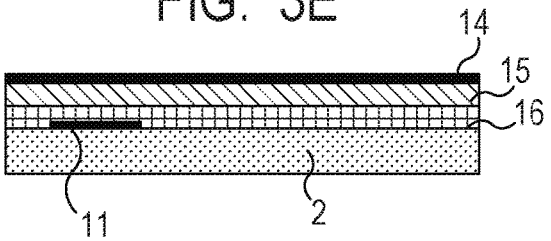
Figure 3F:
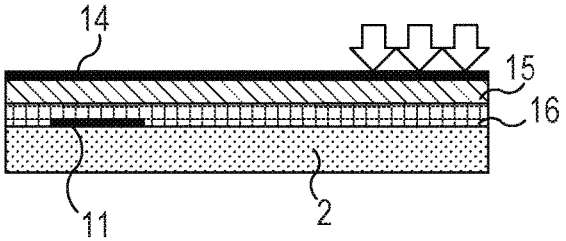
Figure 3G:
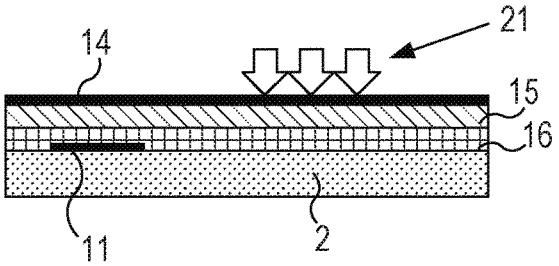

Subsequently, as illustrated in FIG. 3E, a water repellent material having high water repellency is applied onto the top plate 15 to form the high water-repellency region 14. For the application of the water repellent material, the water repellent material is applied so that the high water-repellency region 14 is formed at least around positions at which the ejection ports 10 are formed. As in the case of the top plate 15 and the flow passaged member 16, it is preferred that the water repellent material be a negative type photosensitive resin. Further, there are the following examples as a patterning method for forming part of the surface of the top plate 15 as the low water-repellency region 23. There are a method of exposing the water repellent material under a state in which part of the water repellent material is covered with the exposure mask as illustrated in FIG. 3F and a method of performing ashing with use of an oxygen plasma 21 as illustrated in FIG. 3G after the light exposure to remove the water repellent material. With a patterning technique with use of the exposure pattern as illustrated in FIG. 3F, the pattering for the top plate 15 and the patterning for the flow passage member 16 may be performed in similar steps. Thus, the same device for patterning can be used for part of the above-mentioned patterning steps. Hence, cost for the above-mentioned steps and the device can be reduced. With the technique using the ashing illustrated in FIG. 3G, a water repellent material other than the photosensitive resin can be patterned. Thus, a range of selection of the water repellent material can be expanded.

Figure 3H:
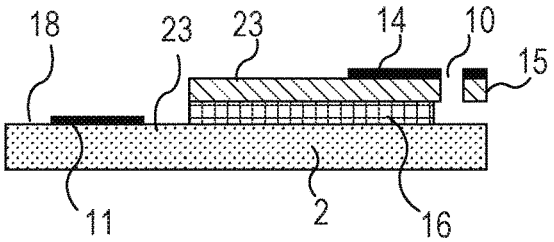

As a final step, as illustrated in FIG. 3H, the photosensitive resins described above are developed to form the flow passage member 16, the top plate 15, and the high water-repellency region 14.

An example of the manufacturing method using the exposure mask, which is described above with reference to FIG. 3F, is described in more detail below. As described above, the ejection port forming surface 17 of the ejection port forming member 3 illustrated in FIG. 1, which has a desired pattern, is formed through selective light exposure of the photosensitive resin applied onto the substrate 2 with the light such as the ultraviolet light 20 radiated from a light source through the exposure mask 22 therebetween.

Figure 4A:
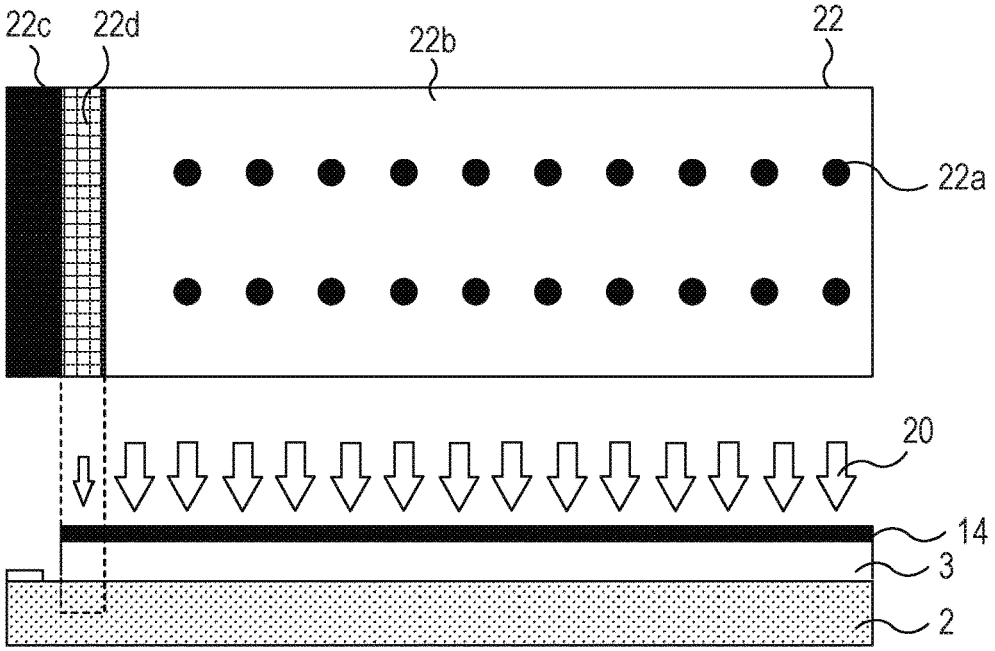
FIG. 4A, FIG. 4B and FIG. 4C are views for illustrating the example of the method of manufacturing the element substrate, which uses an exposure mask, according to the first embodiment of the present disclosure.
Figure 4B:
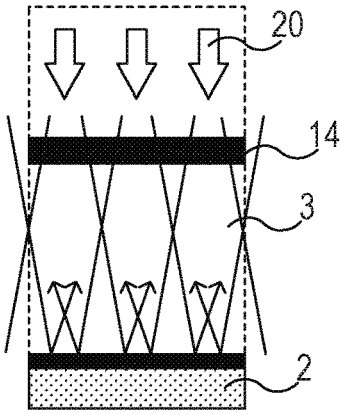
Figure 4C:
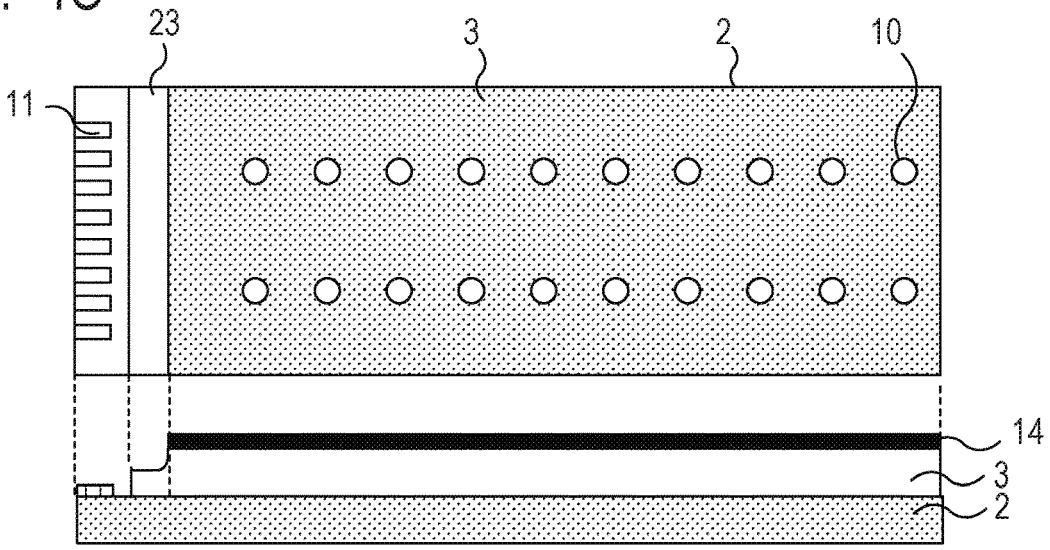

FIG. 4A to FIG. 4C are views for illustrating an example of the manufacturing method using the exposure mask according to the first embodiment. FIG. 4A is a view for illustrating an example of a configuration of the exposure mask according to the first embodiment. In FIG. 4A, upper part corresponds to a plan view and lower part correspond to a side view for convenience. As illustrated in FIG. 4A, the exposure mask 22 includes regions 22*a*, 22*b*, and 22*c*, and a light attenuation region 22*d*. The region 22*b* allows irradiation light such as the ultraviolet light 20 to be transmitted therethrough. The regions 22*a* and 22*c* block the irradiation light. In the light attenuation region 22*d*, the light is attenuated. More specifically, on the light attenuation region 22*d* of the exposure mask 22, a line-and-space pattern at a resolution equal to or lower than a resolution of the ejection port forming member 3 made of the photosensitive resin is formed. The pattern may be, for example, a grid pattern. Alternatively, the pattern may be a pattern having a plurality of dots or other patterns.

FIG. 4B is a view for more specifically illustrating a photoreaction state under the light attenuation region 22*d* illustrated in FIG. 4A. As illustrated in FIG. 4B, the high water-repellency region 14, which is an upper layer, and the ejection port forming member 3 lying thereunder are exposed to the irradiation light such as the ultraviolet light 20 at the same time. Light exposure conditions for the light attenuation region 22*d* are set so that a photoreaction of the ejection port forming member 3 is incomplete in a surface layer thereof in the vicinity of the high water-repellency region 14 and sufficiently proceeds in a portion between the surface layer and a lower layer and in the lower layer. Through the setting of the light exposure conditions described above, only the surface layer of the ejection port forming member 3 dissolves in etching after the light exposure. As a result, a structure illustrated in FIG. 4C can be obtained. In FIG. 4C, as in FIG. 4A, upper part corresponds to a plan view and lower part corresponds to a side view for convenience. Specifically, the low water-repellency region 23 is formed after removal of the high water-repellency region 14. As a result, the low water-repellency region 23 having high adhesion with the sealant when the sealant is applied thereon can be obtained. As illustrated in FIG. 4C, the low water-repellency region 23 has a slightly smaller film thickness than that of the high water-repellency region 14 to thereby form a level difference between the low water-repellency region 23 and the high water-repellency region 14. A height difference of the low water-repellency region 23 from the high water-repellency region 14 can be controlled through the setting of the light exposure conditions. With use of the manufacturing method of this embodiment, the low water-repellency region 23 can be formed with a significantly small level difference of, for example, 10 μm or smaller. The level difference may be formed into an inclined manner.

An example of the light exposure conditions for the light attenuation region 22*d* is now described. The irradiation light such as the ultraviolet light 20 tends to attenuate in a direction toward the lower layer. Thus, in order to improve photosensitivity inside the ejection port forming member 3, a focus position for exposure light is set on an inner side with respect to an uppermost surface. A light beam is focused at a position on an inner side with respect to the uppermost layer. With the light beam focused at the position on the inner side with respect to the uppermost surface, a light beam density of a portion around the position becomes higher, and hence the photoreaction on the inner side with respect to the uppermost surface is more accelerated. In the vicinity of the substrate 2, the light beam density becomes higher with reflected light from the surface of the substrate 2. Unless a material for absorbing the light beam is provided on the surface of the substrate 2, the photoreaction on the inner side with respect to the uppermost surface is more accelerated. The ejection ports 10 can be formed during the light exposure. Thus, in the manufacturing method of this embodiment, an additional process is not required for a general ejection port formation process. Thus, the manufacturing method of this embodiment is advantageous in terms of productivity and cost.

Figure 5A:
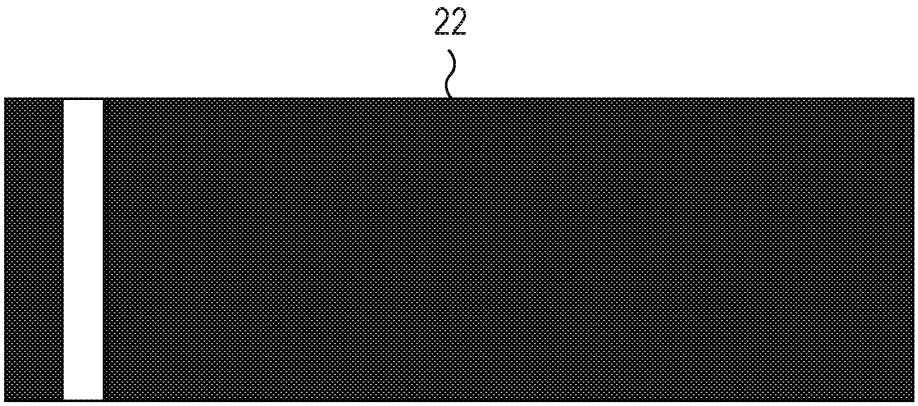
FIG. 5A, FIG. 5B and FIG. 5C are views for illustrating another example of the method of manufacturing the element substrate, which uses the exposure mask, according to the first embodiment of the present disclosure.
Figure 5B:
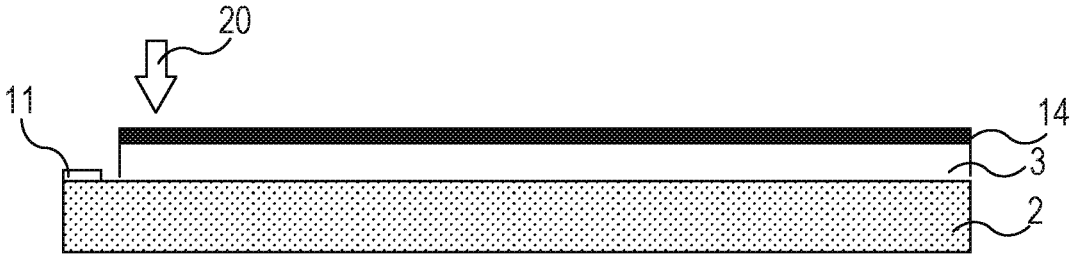
Figure 5C:
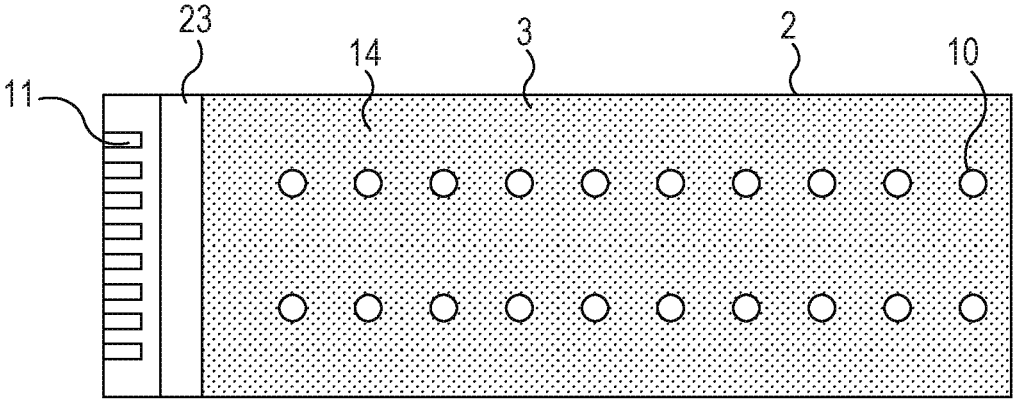

FIG. 5A to FIG. 5C are views for illustrating another example of the manufacturing method using the exposure mask according to this embodiment. The manufacturing method is accomplished by application of a technology described in Japanese Patent Application Laid-Open No. 2016-43515. With the manufacturing method, after the light exposure for forming the ejection ports, light having a decomposition wavelength for a water repellent component of the high water-repellency region 14 (for example, the ultraviolet ray 20) is selectively radiated to form the high water-repellency region 14 and the low water-repellency region 23. The surface around each of the ejection ports has a perfectly flat shape. Thus, in a case of an inspection with image observation of the surface, there is an advantage in that the surface may easily be brought into a focus position.

With the formation of the top plate 15 and the flow passage member 16 through the steps described above, the high water-repellency region 14 can be formed around the ejection ports 10, and the low water-repellency region 23 can be formed in the vicinity of the terminals 11.

Second Embodiment (Description of Structure)

FIG. 6A to FIG. 6D are examples of a plan view of the element substrate and a sectional view of the vicinity of the terminals according to a second embodiment of the present disclosure. In each of FIG. 6A to FIG. 6D, upper part corresponds to a plan view and lower part corresponds to a sectional view for convenience. In the second embodiment, a sealing region to be sealed with the sealant 13 on the ejection port forming surface 17 of the ejection port forming member 3 is divided into a plurality of regions. With the structure describe above, an adhesion area between the top plate 15 and the sealant 13 can be increased. As a result, the sealability between the top plate 15 and the sealant 13 can be further improved. The low water-repellency region 23 is divided as the region of the ejection port forming member 3, which is to be divided into the plurality of regions. In the mode illustrated in FIG. 6A, one cutout 30 is formed in the low water-repellency region 23 through the top plate 15 and the flow passage member 16. The cutout 30 passes through the top plate 15 and the flow passage member 16. With the cutout 30, the adhesion area with the sealant 13 is increased. As a result, the sealability can be improved. In the mode illustrated in FIG. 6B, a plurality of cutouts 30 are formed in the low water-repellency region through the top plate 15 and the flow passage member 16. With the plurality of cutouts 30, the adhesion area with the sealant 13 becomes larger than that in the mode illustrated in FIG. 6A. Thus, the sealability can be further improved. In the mode illustrated in FIG. 6C, one cutout 31 is formed in the low water-repellency region of the top plate 15. The cutout 31 is not formed in the flow passage member 16. Thus, the cutout having a smaller depth than that in the mode illustrated in FIG. 6A may be formed. With the cutout having the smaller depth, the sealant 13 easily moves into the cutout 31 to thereby reduce entry of air bubbles into the cutout 31. As a result, the adhesion area with the sealant 13 is increased, and hence the sealability can be further improved. In a mode illustrated in FIG. 6D, a plurality of the cutouts 31 are formed in the low water-repellency region of the top plate 15. The cutout 31 is not formed in the flow passage member 16. With the plurality of cutouts 31, the adhesion area with the sealant 13 becomes larger by the number of cutouts 31 than in the mode illustrated in FIG. 6C. As a result, the sealability can be further improved.

(Description of Manufacturing Method for Carrying Out Second Embodiment)

Figure 6A:
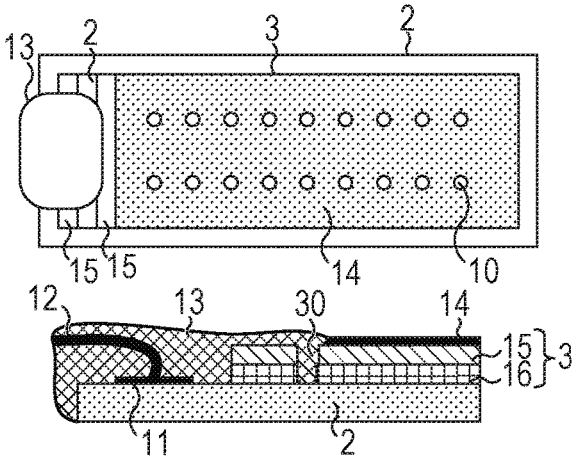
FIG. 6A, FIG. 6B, FIG. 6C and FIG. 6D are examples of a plan view of the element substrate and a sectional view of the vicinity of terminals in a second embodiment of the present disclosure.
Figure 6B:
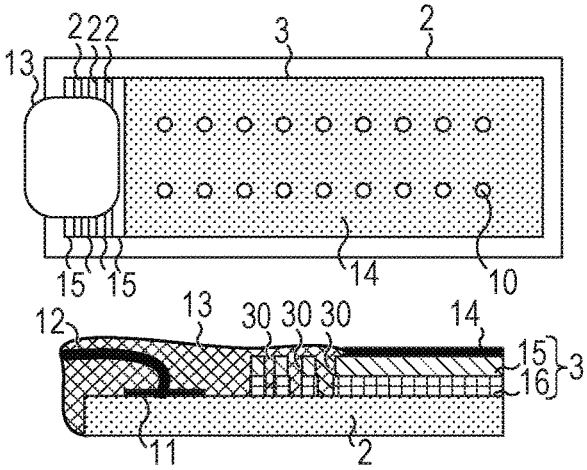
Figure 6C:
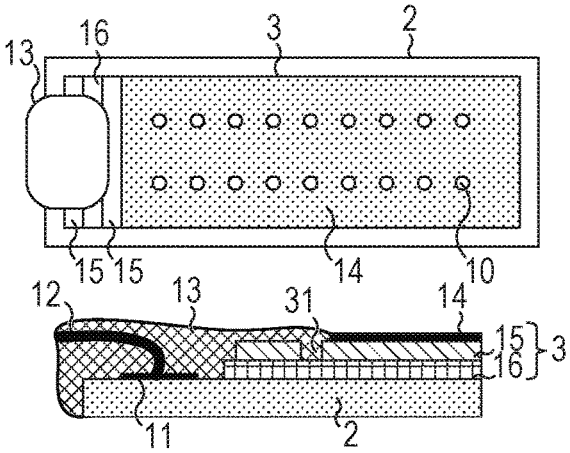
Figure 6D:
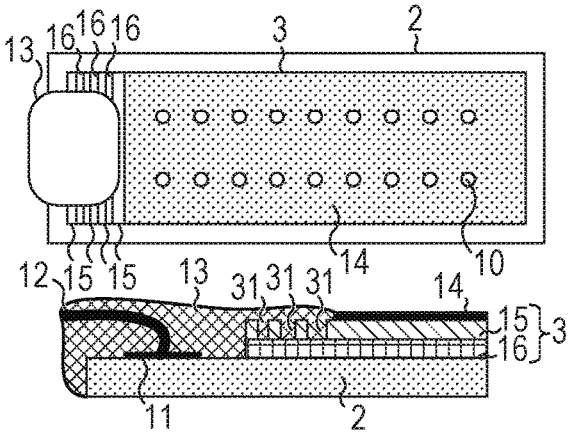

The manufacturing method for forming the electrode substrate described above is described based on the steps of carrying out the first embodiment (described above with reference to FIG. 3A to FIG. 3G). As illustrated in FIG. 6A and FIG. 6B, when the cutout 30 is formed in both of the top plate 15 and the flow passage member 16, the region in which the cutout 30 is formed is only required to be set as a non-exposed region in each of the steps described above with reference to FIG. 3A to FIG. 3D. When the cutout 31 is formed so as to divide only the top plate 15 into a plurality of regions as illustrated in FIG. 6C and FIG. 6D, the region in which the cutout 31 is formed is only required to be set as a non-exposed region in each of the steps described above with reference to FIG. 3C and FIG. 3D. In the manner described above, the plurality of regions of the top plate 15 can be developed at the same time as in the case of the first embodiment.

Third Embodiment

Figure 7A:
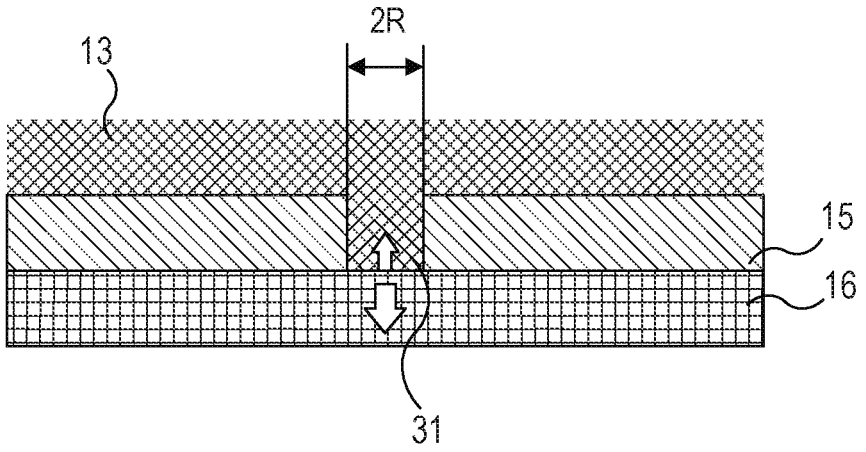
FIG. 7A is an example of a sectional view of an ejection port forming member and a sealant in a third embodiment of the present disclosure.
Figure 7B:
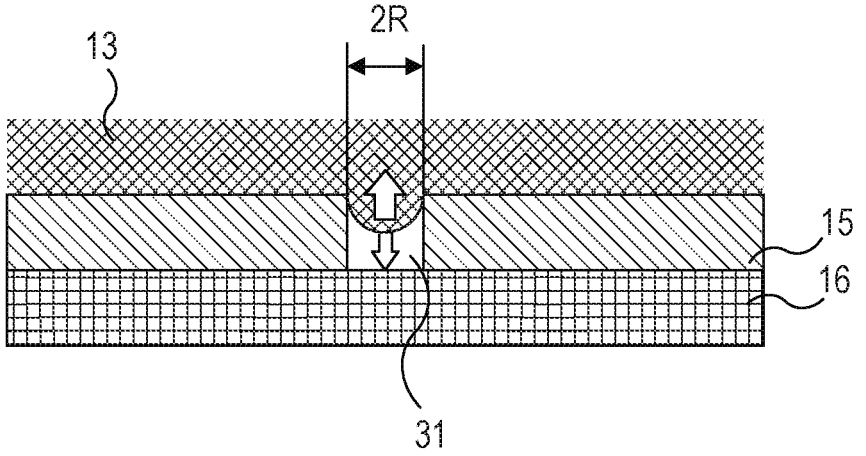
FIG. 7B is a sectional view of the ejection port forming member and the sealant in a case in which a condition for a length of a cutout is not satisfied.

FIG. 7A is an example of a sectional view of the ejection port forming member and the sealant in a third embodiment of the present disclosure, and FIG. 7B is a sectional view of the ejection port forming member and the sealant in a case in which a condition for a length of a cutout is not satisfied. When a length (opening width) of the cutout 31 formed in the ejection port forming surface 17 of the top plate 15 illustrated in FIG. 7A and FIG. 7B is set to 2R, it is preferred that the opening width 2R of the cutout 31 formed in the top plate 15 be a length expressed by:

$$\frac{2}{3}\pi R\rho g > \frac{\sigma}{\pi R} \qquad \text{(Expression 1)}$$

where ρ represents a density of the sealant, g represents a gravitational acceleration, and σ represents a surface tension of the sealant. When the cutout 31 has the opening width 2R satisfying Expression 1, the own weight of the sealant 13 (see the downward arrow in FIG. 7A) becomes larger than a surface pressure (see the upward arrow in FIG. 7A) of a meniscus formed with the sealant 13. Thus, the sealant 13 easily moves into the cutout 31 as illustrated in FIG. 7A. As a result, air bubbles can be prevented from remaining in the cutout 31. The air bubbles do not remain in the cutout 31, and hence a sufficient sealing region can be ensured. Thus, the sealability can be further improved. Meanwhile, when the opening width 2R of the cutout 31 does not satisfy Expression 1, the air bubbles remain in the cutout 31 as illustrated in FIG. 7B. Although the air bubbles are not illustrated, the air bubbles remain in the vicinity of the downward arrow in FIG. 7B.

In the examples illustrated in FIG. 7A and FIG. 7B, the cutout 31 is formed only in the top plate 15. In the present disclosure, however, the cutout 31 may be formed not only in the top plate 15 but also in both of the top plate 15 and the flow passage member 16. Further, the plurality of cutouts 31 may be formed. When the surface tension σ is set to 20 mN/m, and the density ρ is set to 1,000 kg/m$^3$ as typical values of physical property values of the sealant, the opening width 2R of the cutout 31 is 1 mm.

Fourth Embodiment

Figure 8:
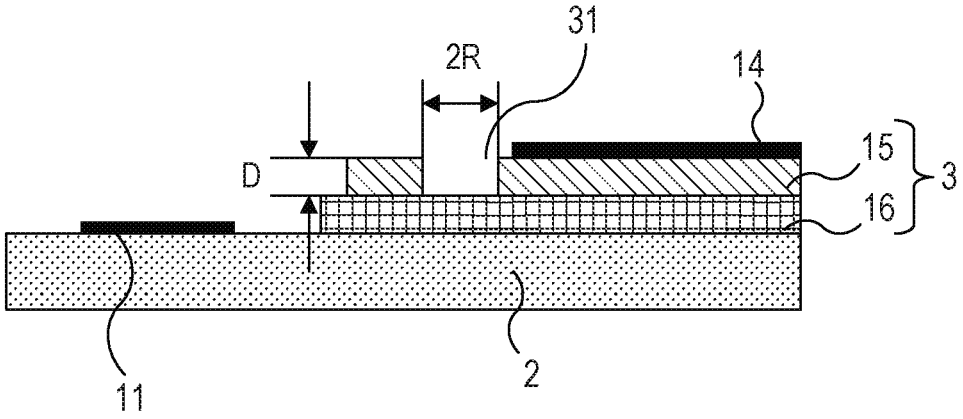
FIG. 8 is an example of a sectional view of the ejection port forming member and the sealant in a fourth embodiment of the present disclosure.

FIG. 8 is an example of a sectional view of the ejection port forming member and the sealant in a fourth embodiment of the present disclosure. In the mode illustrated in FIG. 8, the cutout 31 is formed only in the top plate 15. However, the cutout 31 may be formed in both of the top plate 15 and the flow passage member 16. The plurality of cutouts 31 may be formed. When the opening width 2R of the cutout 31 formed in the top plate 15 is set to 2R and a depth (thickness) of the cutout 31 formed in the top plate 15 is set to D, it is preferred that the opening width R and the depth D satisfy $$2R>D \quad \text{(Expression 2).}$$

In the structure described above, the sealant 13 applied onto at least part of the low water-repellency region 23 comes into contact with a bottom surface of the cutout 31 formed in the top plate 15 (a surface of the flow passage member 16 in the mode illustrated in FIG. 8) before the sealant 13 forms the meniscus. Thus, the air bubbles are less liable to enter the cutout 31 than that given in the third embodiment. As a result, a sufficient sealing region is ensured, and hence the sealability can be further improved.

Fifth Embodiment (Description of Structure)

Figure 9:
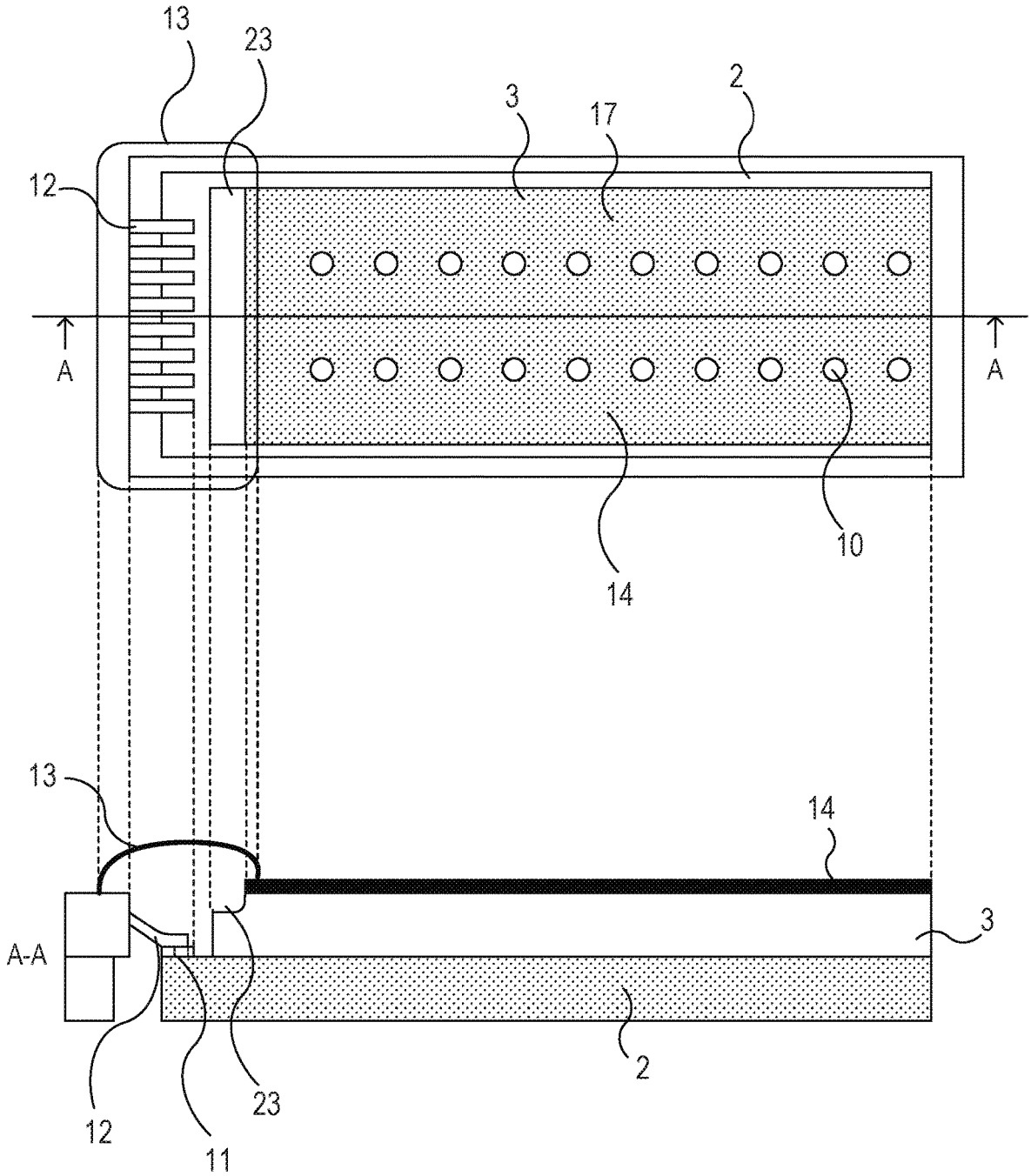
FIG. 9 is an example of a plan view and a sectional view of the element substrate in a fifth embodiment of the present disclosure.

FIG. 9 is an example of a plan view and a sectional view of the element substrate in a fifth embodiment of the present disclosure. In FIG. 9, upper part corresponds to a plan view and lower part corresponds to a sectional view for convenience. In this embodiment, the electric wirings 12, the terminals 11, and the terminal region 41 are sealed with the sealant 13. As illustrated in FIG. 9, an entire surface of the end region 41 is covered with the sealant 13. As a result, the ink can be prevented from being accumulated on the end region 41 of the ejection port forming surface 17 of the ejection port forming member 3. The ink accumulation may cause dropping of the ink during the printing. Thus, in general, the ink is periodically removed by cleaning means such as wiping. In the fifth embodiment, a surface having low water repellency, which may be a starting point of the ink accumulation, is not exposed. Thus, the fifth embodiment is superior to the other embodiments in terms of ink removability. The sealant 13 generally has a convex shape with respect to the ejection port forming surface 17. Thus, when the wiping is performed in a direction of arrangement of the ejection ports, the ink removability in the vicinity of the sealant 13 is low. The structure of the fifth embodiment has especially large effects in the structure in which the wiping is performed in the direction of arrangement of the ejection ports.

In the fifth embodiment, at least a portion of a surface area of the ejection port forming member 3, which is covered with the sealant 13 and is located on a side closer to a mounting portion for the electric wirings 12, is formed as the low water-repellency region 23. Thus, in the vicinity of the mounting portion for the electric wirings 12, the sealant 13 and the ejection port forming member 3 firmly adhere to each other, and hence high electric reliability can be ensured. For the low water-repellency region 23, it is desired that an area equal to or larger than one-fifth of the region of the surface of the ejection port forming member 3, which is covered with the sealant 13, be ensured.

As described above, according to the fifth embodiment, the region onto which the sealant 13 is applied is formed as the low water-repellency region 23 to thereby improve the electric reliability. At the same time, the high water-repellency region 14 is formed outside the region on which the sealant 13 is provided to thereby ensure cleaning ability of the ejection port forming surface 17.

As described above, according to the present disclosure, the region around the ejection ports for the ink is water-repellent finished to form the region as the high water-repellency region. The region between the ejection ports and the terminals, which is at least part of the low water-repellency region other than the high water-repellency region, and the terminals are covered with the sealant. As a result, the ejection port forming member 3 can be firmly sealed with the sealant. At the same time, reduction in the electric reliability due to flow of the ink to the terminals can be prevented.

The embodiments of the present disclosure have been described above. However, the description is not intended to limit the scope of the present disclosure. In the embodiments described above, there has been described the example in which a thermal method of generating air bubbles with use of heat-generating elements to eject the liquid is adopted. However, the present disclosure is also applicable to liquid ejection heads using a piezo method and other various liquid ejection methods. Further, the embodiments described above are also applicable to a so-called line head having a length corresponding to a width of a recording medium and a so-called serial liquid ejection head configured to perform recording while scanning the ejection port forming member. In the embodiments described above, the electrodes may be arranged in a longitudinal direction of the element substrate, in a transverse direction of the element substrate, or in both of the longitudinal direction and the transverse direction. The electrodes may also be arranged in a diagonal direction with respect to the element substrate. The embodiments described above are applied to the ink jet recording head configured to eject the ink as a target. However, the liquid to be ejected is not limited to the ink.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-165902, filed Sep. 5, 2018, which is hereby incorporated by reference herein in its entirety.

What is claimed is:

1. A liquid injection head comprising:

a substrate including:

energy generating elements configured to apply energy for ejection to a liquid; and a substrate upper surface on which terminals respectively connected to electric wirings are provided;

an ejection port forming member having:

an ejection port forming surface in which ejection ports for ejecting a liquid are formed, and having an end region which includes at least one cutout; and a back surface on a side opposite to the ejection port forming surface, which is arranged so as to opposite to the substrate upper surface; and a sealant configured to cover connecting portions between the electric wirings and the terminals, wherein at least an ejection port region of the ejection port forming surface, in which the ejection ports are formed, is formed as a high water-repellency region, wherein the end region of the ejection port forming surface, which is located between the ejection port region and the terminals when the substrate upper surface is viewed in plan view, is formed as a low water-repellency region having water repellency lower than water repellency of the high water-repellency region, and wherein at least a part of the end region including the cutout is covered with the sealant, wherein, when an opening width of the cutout on the ejection port forming surface is set to 2R, a density of the sealant is set to ρ, a surface tension of the sealant is set to σ, and a gravitational acceleration is set to g, the cutout is formed so as to satisfy;

$$\frac{2}{3}\pi R\rho g > \frac{\sigma}{\pi R}.$$

2. The liquid ejection head according to claim 1, wherein, when an opening width of the cutout on the ejection port forming surface is set to 2R and a depth of the cutout is set to D, the cutout is formed so as to satisfy:

$$2R>D.$$

3. The liquid ejection head according to claim 1, wherein the ejection port forming member includes:

a top plate through which the ejection ports are formed; and a flow passage member configured to communicate with the ejection ports and form a supply flow passage for the liquid, and wherein the cutout is formed to pass through the top plate and the flow passage member.

4. The liquid ejection head according to claim 1, wherein the sealant covers an entire surface of the end region.

5. A liquid injection head comprising:

a substrate including:

energy generating elements configured to apply energy for ejection to a liquid; and a substrate upper surface on which terminals respectively connected to electric wirings are provided;

an ejection port forming member having:

an ejection port forming surface in which ejection ports for ejecting a liquid are formed, and having an end region which includes at least one cutout; and a back surface on a side opposite to the ejection port forming surface, which is arranged so as to be opposite to the substrate upper surface; and a sealant configured to cover connecting portions between the electric wirings and the terminals, wherein at least an ejection port region of the ejection port forming surface, in which the ejection ports are formed, is formed as a high water-repellency region, wherein the end region of the ejection port forming surface, which is located between the ejection port region and the terminals when the substrate upper surface is viewed in plan view, is formed as a low water-repellency region having water repellency lower than water repellency of the high water-repellency region, and wherein at least a part of the end region including the cutout is covered with the sealant, wherein, when an opening width of the cutout on the ejection port forming surface is set to 2R and a depth of the cutout is set to D, the cutout is formed so as to satisfy:

$$2R>D.$$

6. The liquid ejection head according to claim 5, wherein, when an opening width of the cutout on the ejection port forming surface is set to 2R, a density of the sealant is set to ρ, a surface tension of the sealant is set to σ, and a gravitational acceleration is set to g, the cutout is formed so as to satisfy:

$$\frac{2}{3}\pi R\rho g > \frac{\sigma}{\pi R}.$$

7. The liquid ejection head according to claim 5, wherein the ejection port forming member includes:

a top plate through which the ejection ports are formed; and a flow passage member configured to communicate with the ejection ports and form a supply flow passage for the liquid, and wherein the cutout is formed to pass through the top plate and the flow passage member.

8. The liquid ejection head according to claim 5, wherein the sealant covers an entire surface of the end region.

* * * * *